US005470039A

United States Patent [19]

Hilger

[11] Patent Number: 5,470,039

[45] Date of Patent: Nov. 28, 1995

[54] FOLDABLE INFANT SEAT CRADLE AND SUPPORT STAND

[75] Inventor: Jeff H. Hilger, Stillwater, Minn.

[73] Assignee: Koala Corporation, St. Paul, Minn.

[21] Appl. No.: 243,806

[22] Filed: May 17, 1994

[51] Int. Cl.[6] ..... F16M 11/20

[52] U.S. Cl. ..... 248/164; 248/166; 297/45

[58] Field of Search ..... 248/165, 166, 248/164, 432, 461, 188.1; 297/45, 457; 211/182, 13; 108/71

[56] References Cited

U.S. PATENT DOCUMENTS

| | | | |
|---|---|---|---|
| 334,674 | 1/1886 | Neal . | |
| 4,832,34 | 5/1889 | LaFreniere | 280/30 |
| 1,310,669 | 7/1919 | Morgan . | |
| 1,426,160 | 8/1922 | Driver . | |
| 1,762,580 | 6/1930 | Menk | 248/164 X |
| 1,941,902 | 1/1934 | Lewis | 5/98 |
| 2,467,900 | 4/1949 | Maine | 248/164 X |
| 2,626,118 | 1/1953 | Rice | 248/165 |
| 2,645,442 | 7/1953 | Brodine | 248/164 |
| 2,676,709 | 4/1954 | Walsh | 248/432 |
| 2,710,642 | 6/1955 | Fauser | 155/56 |
| 2,939,584 | 6/1960 | Bergman, Jr. | 211/27 |
| 3,071,409 | 1/1963 | Gibson et al. | 297/45 |
| 3,150,616 | 9/1964 | Berlin | 108/16 |
| 3,270,693 | 9/1966 | Lind | 108/16 |
| 3,341,028 | 9/1967 | Nichols | 211/182 X |
| 3,351,380 | 11/1967 | Sprague | 297/377 |
| 3,502,291 | 3/1970 | Ackerman et al. | 248/97 |
| 3,754,786 | 8/1973 | Boucher et al. | 297/5 |
| 3,839,754 | 10/1974 | Hooper | 5/98 A |
| 3,893,648 | 7/1975 | Gilbert | 248/97 |
| 4,321,874 | 3/1982 | Cenna | 211/182 X |
| 4,516,806 | 5/1985 | McDonald et al. | 297/457 |
| 4,580,750 | 4/1986 | Spellman | 248/164 |
| 4,723,741 | 2/1988 | Doering | 248/164 X |
| 4,750,783 | 6/1988 | Irby et al. | 197/250 |
| 4,770,410 | 9/1988 | Brown | 272/70.3 |
| 4,796,314 | 1/1989 | Garduno | 248/164 X |
| 4,886,229 | 12/1989 | Aripze-Gilmore | 248/125 |
| 4,971,284 | 11/1990 | Curry | 248/165 X |
| 4,982,997 | 1/1991 | Knoedler et al. | 297/296 |
| 5,005,234 | 4/1991 | Kelleher et al. | 5/94 |
| 5,054,849 | 10/1991 | Hoff | 297/45 |
| 5,146,635 | 9/1992 | Gastle et al. | 5/620 |
| 5,312,076 | 5/1994 | Rogov | 248/165 |

FOREIGN PATENT DOCUMENTS

| | | | |
|---|---|---|---|
| 555211 | 6/1923 | France . | |
| 1019416 | 1/1953 | France | 248/432 |
| 14195 | 10/1915 | United Kingdom . | |
| 233865 | 1/1925 | United Kingdom . | |

OTHER PUBLICATIONS

"The Infant Safety Chair", Prodcut Safety and Education, prior to May 17, 1994.

*Primary Examiner*—J. Franklin Foss
*Attorney, Agent, or Firm*—Nawrocki, Rooney & Sivertson

[57] ABSTRACT

A foldable cradle for supporting an infant seat. The foldable cradle includes a pair of spaced, generally parallel, cross-members, each cross-member having a leg depending from one end thereof and a second leg depending from the other leg thereof. The first legs are pivotally connected at a point intermediate the first legs and the second legs are pivotally connected at a point intermediate the second legs so that a frame is formed having an X-shape when viewed from the side in an open position. In the open position, the cross-members are each at a fixed vertical elevation above a planar surface defined by the opposite end of the legs. The foldable cradle includes means for supporting an infant seat. The means includes a flexible member secured on one end to one of the cross-members secured to the opposing end of the other cross-members to form a swing wherein the infant seat is supported by the flexible member as suspended therebetween, The flexible member is preferably a meshed fabric material such as nylon strand fixedly connected in a web-like pattern.

9 Claims, 8 Drawing Sheets

FOLDABLE INFANT SEAT CRADLE AND SUPPORT STAND

TECHNICAL FIELD

The present invention relates to foldable or collapsible support apparatus. More narrowly, it is directed to a foldable cradle for supporting an infant seat which is convertible to a collapsible storage bin.

BACKGROUND OF THE INVENTION

Infant seats manufactured from molded plastic and other materials to generally conform to the shape and protect a small infant are commonplace. These seats have become even more commonplace with the recognition that such seats, as designed for use in conjunction with safety belts in an automobile, reduce the risk of injury during an accident. Many states now have laws which require use of approved infant seats for children below a certain age while traveling in an automobile.

Infant seats which are not utilized in automobiles are also commonplace. These seats provide a comfortable environment, particularly for an infant who is not yet able to sit erect. The seats usually incorporate a molded plastic seat area with a back support which is inclined to a position wherein a small infant is properly supported. A combination support/handle is usually included which may be rotated to a position so that it can be used for carrying the infant seat.

Many of the newer infant seats which are utilized in automobiles are designed as two piece units. The infant seat includes a base which is secured in the automobile by the seatbelt and a removable infant seat portion which is releasably secured to the base during use in the automobile. This design allows the parent or care giver to simply remove the infant seat from the automobile with the infant still comfortably therein. This is particularly useful when the infant is napping. Parents benefit by being able to transport an infant who is sleeping comfortably in the infant seat as they move from the automobile into a public facility, such as a restaurant. Thus, the removable infant car seat may be utilized in the same way as the non-motor vehicle infant seat.

It is very common to see parents or care givers carrying young infants in an infant seat at public places, such as restaurants, churches, doctor's offices, and any other family-oriented public places. The infant seats provide a convenient means for carrying the young infant while comfortably supporting and protecting the infant. The infant seat also provides a resting place so that the parent need not hold the infant at all times when they are too young to sit unsupported.

Once in a public place, the parent utilizing the infant seat faces the problem of finding a safe and adequate spot to place the infant seat with the infant resting within. Most surfaces are not designed to adequately hold and secure the infant seat. Table tops or benches or chairs generally do not provide adequate surface area for holding the seat.

Thus, in many instances, the infant seat may be accidentally bumped or tipped, resulting in injury to the child. These problems are particularly evident in a restaurant. The infant left strapped in an infant seat and placed on the table or on an unsecure chair or booth seat is exposed to the risk of being accidentally pushed over or being burned by hot food and drink. If the infant seat is placed on the floor, the child faces similar risks and the additional risk of being tripped over by staff or customers. Standard high chairs available in restaurants are not suitable for small infants.

Infant seats are also utilized within the home. It is many times desirable to place the child in the infant seat while attending to tasks, such as cooking, cleaning or caring for siblings. It is desirable to have a safe location to place the infant seat during these times. Placing the infant in the seat on the floor may result in someone tripping over the infant while many places of higher elevation, such as chairs or countertops, do not provide adequate surface area. The infant seat can readily slip off such surfaces or be bumped off such surfaces. As with other infant care products for home use, the utility of the device when outgrown for its main purpose is also an issue.

Accordingly, the need exists for a foldable cradle for supporting an infant seat which may be utilized in public places by patrons or in the home by those who prefer to place their child in such infant seats. The foldable cradle should include means for safely securing the infant seat within the cradle at an elevated height to make the infant seat highly visible. The foldable cradle should also secure the infant seat from accidental tipping and allow placement of the infant seat near the parents, yet away from hazards, such as hot food or drink. For home use, it is also preferable that the seat have other utility when the infant outgrows the infant seat and no longer needs the foldable cradle. It is also preferable that the infant seat cradle be foldable and readily stored to minimize use of floor space when not in use.

The present invention addresses these needs as well as other problems associated with the use of infant seats in homes or public areas. The present invention also offers further advantages over the prior art and solves problems associated therewith.

SUMMARY OF THE INVENTION

The present invention is a foldable cradle, for use in supporting an infant seat, alone and in combination with a support stand which receives and holds folded cradles when not in use. The foldable cradle is specifically designed and intended to securely receive infant seats of various size and design, while supporting such seats at an elevated height above the floor. The foldable cradle can be used in the home to provide a safe place to position the infant seat. The foldable cradle is also an inexpensive apparatus which proprietors of public places can provide for use by their customers. The foldable cradle allows parents who patronize a public place, such as a family restaurant, by allowing them to carry and leave their infant within the infant seat they are utilizing. The foldable cradle assures the infant in the infant seat will be secure and safe in close proximity to the patrons' table while dining and conducting other activities.

The foldable cradle of the present invention for supporting an infant seat includes a pair of spaced, generally parallel cross-members. Each cross-member has a first leg depending from one end thereof and a second leg depending from the other end thereof. The first legs are pivotally connected at a point intermediate the first legs, and the second legs are pivotally connected at a point intermediate the second legs. In an open position, a frame having an X-shape, when viewed from the side, is formed. The cross-members, when the frame is in an open position, are each at a fixed vertical elevation above a planar surface such as the floor, such elevation being defined by the lengths of the legs.

The frame, described above will, typically, comprise a first U-shaped member having a first cross-member with a first leg depending from one end thereof and a second leg depending from the other end thereof. The frame would also include a second U-shaped member having a second cross-member with a first leg depending from one end thereof and a second leg depending from the other end thereof. The first leg of the second U-shaped member is pivotally connected to the first leg of the first U-shaped member at an intermediate point on each first leg. The second leg of the second U-shaped member is pivotally connected to the second leg of the first U-shaped member at an intermediate point on each second leg. Thus, the U-shaped members form a frame on which, in an open position, the first cross-member is generally parallel and spaced a horizontal distance from the second cross-member.

The foldable cradle for supporting an infant seat also includes means for holding the infant seat. The means include a flexible member secured on one end to one of the cross-members and secured on an opposing end to the other of the cross-members to form a sling, wherein the infant seat is supported by the flexible member as suspended therebetween. In preferred embodiments, the sling is manufactured from netting and sewn to generally conform to the bottom of the infant seat. This includes a generally rectangular bottom with generally vertical end and side walls which help prevent the infant seat from tipping when in place.

In one preferred embodiment, the legs of one of the cross-members are longer above the point of pivot than the legs of the other cross-member so that when the frame is in an open position, the vertical elevation from the planar surface, as defined by the lengths of the legs, of one cross-member is greater than the other cross-member. This design allows for receiving a foot end of an infant seat beneath the higher elevated cross-member. The foot end of the infant seat can extend generally horizontally beyond the cross member while the flexible member supports the bottom of the foot end of the seat. The higher elevated cross-member and flexible member cooperate to help secure the infant seat in place.

The flexible member can be a meshed fabric material. Preferably, the meshed fabric material includes nylon strands connected in a web-like pattern. The meshed fabric material readily conforms to the shape of any infant seat while providing sufficient strength to support the seat.

The foldable cradle can further include at least one locking brace, wherein, when the frame is in the open position, the locking brace is rigid between points on each of two pivotally connected legs at a distance from the point intermediate the legs. The brace prevents accidental folding of the cradle during use. The brace also defines the fixed distance between the first cross-member and second cross-member. Thus, the flexible member is sized relative to these fixed positions to allow the inclusion of sufficient excess flexible material for receiving the infant seat. The excess material allows the infant seat to fit beneath one of the cross-members and have its back rest against the other cross-member while the flexible material conforms to a bottom and a portion of the side defined by the shape of the infant seat.

The locking brace, in one preferred embodiment, comprises a first rigid member pivotally connected proximate one end to a second rigid member proximate one end of said second rigid member. The brace further includes means for fixedly securing the first rigid member relative to the second rigid member when the infant seat cradle frame is in the open position.

In one preferred embodiment, each cross member and pair of legs associated therewith are manufactured as a unitary piece in a plastic molding process. The molding process allows incorporation of a preferred design in the area of the pivotal connection. With this design, one of the legs in the pivot area includes at least one shoulder which is laterally displaced and overlying the other leg. The shoulder and upper surface of the leg cooperate to operate as a stop which limits the degree that the legs may be pivoted. Thus, in the open position, the shoulder surface is in contact with the upper surface of the lower portion of the other leg to hold the foldable cradle in proper open position.

The foldable cradle can also include a safety strap. The safety strap is adjustably secured at each end at the pivot point on the pivotally connected legs. Thus, one end of the strap is connected at the pivot point on one pair of legs, while the other end is connected to the other pivot point on the other pair of legs. The strap is of a length sufficient to extend over the top of the flexible member and infant seat when it is in place. Means are provided for adjusting the length of the strap to fit various infant seats.

The cross-members and legs can be manufactured from rigid, hollow tubing. In a preferred embodiment, a cross-member and pair of legs is molded as a unitary piece from plastic.

The present invention can also include, in combination, a support stand having at least one generally horizontal support arm extending, at an elevated position, from a vertical support. In another embodiment, the support stand can include a wall-mounted unit having at least one horizontal support arm extending therefrom. This combination can include a plurality of folded cradles for supporting infant seats suspended from the horizontal support arm. The foldable cradles would, in this combination, incorporate all of the features of the foldable cradles described above.

These and various other advantages and features of novelty which characterize the present invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter in which there are illustrated and described preferred embodiments of the present invention.

BRIEF DESCRIPTION OF THE DRAWINGS

In the drawings, in which like reference numerals indicate corresponding parts or elements of embodiments of the present invention throughout the several views.

DETAILED DESCRIPTION OF THE INVENTION

Detailed embodiments of the present invention are disclosed herein. However, it is to be understood that the disclosed embodiments are merely exemplary of the present invention which may be embodied in various systems. Therefore, specific details disclosed herein are not to be interpreted as limiting, but rather as a basis for the claims and as a representative basis for teaching one of skill in the art to variously practice the invention.

Figure 1:
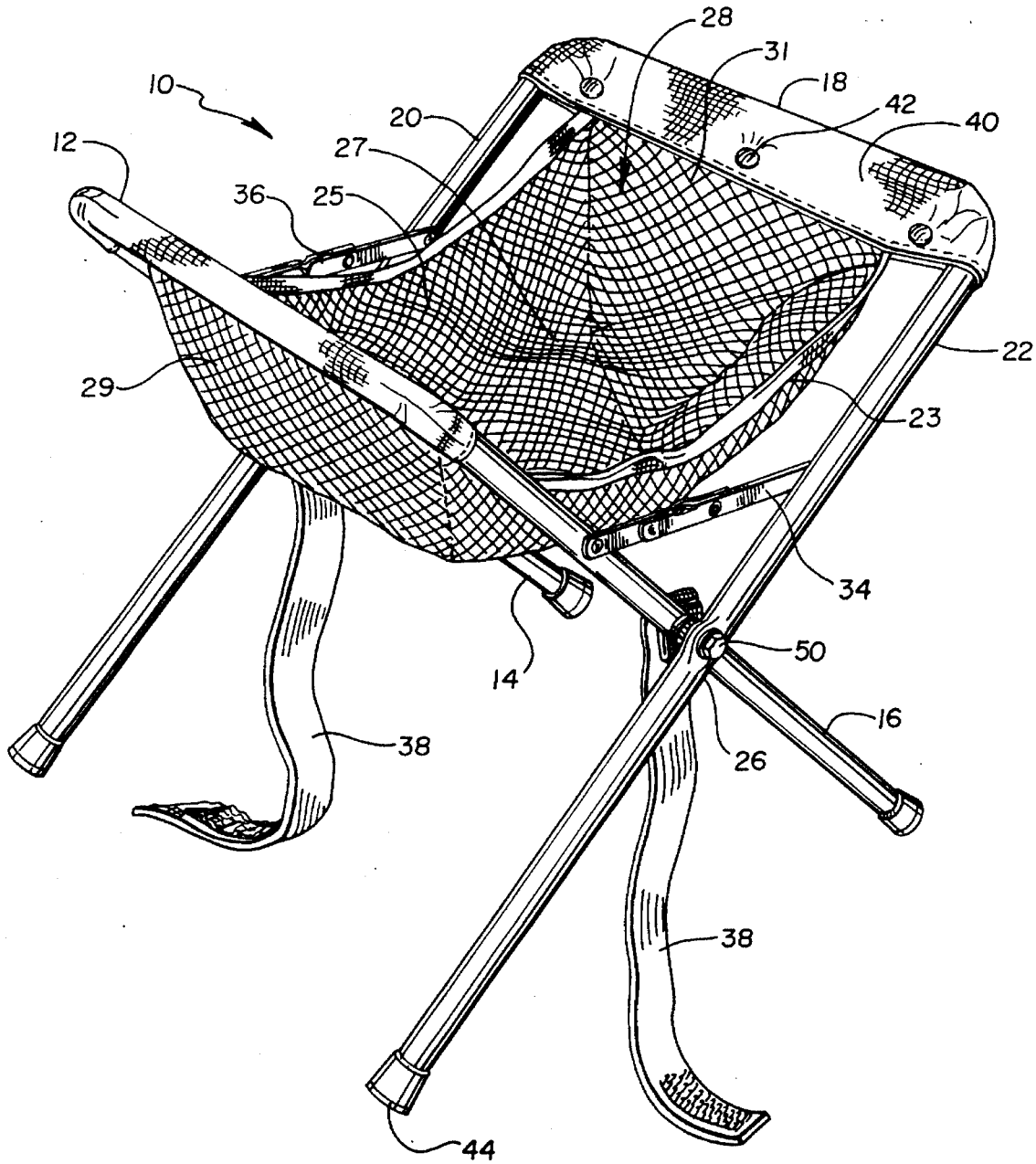
FIG. 1 is a perspective view of a foldable cradle for supporting an infant seat.
Figure 2:
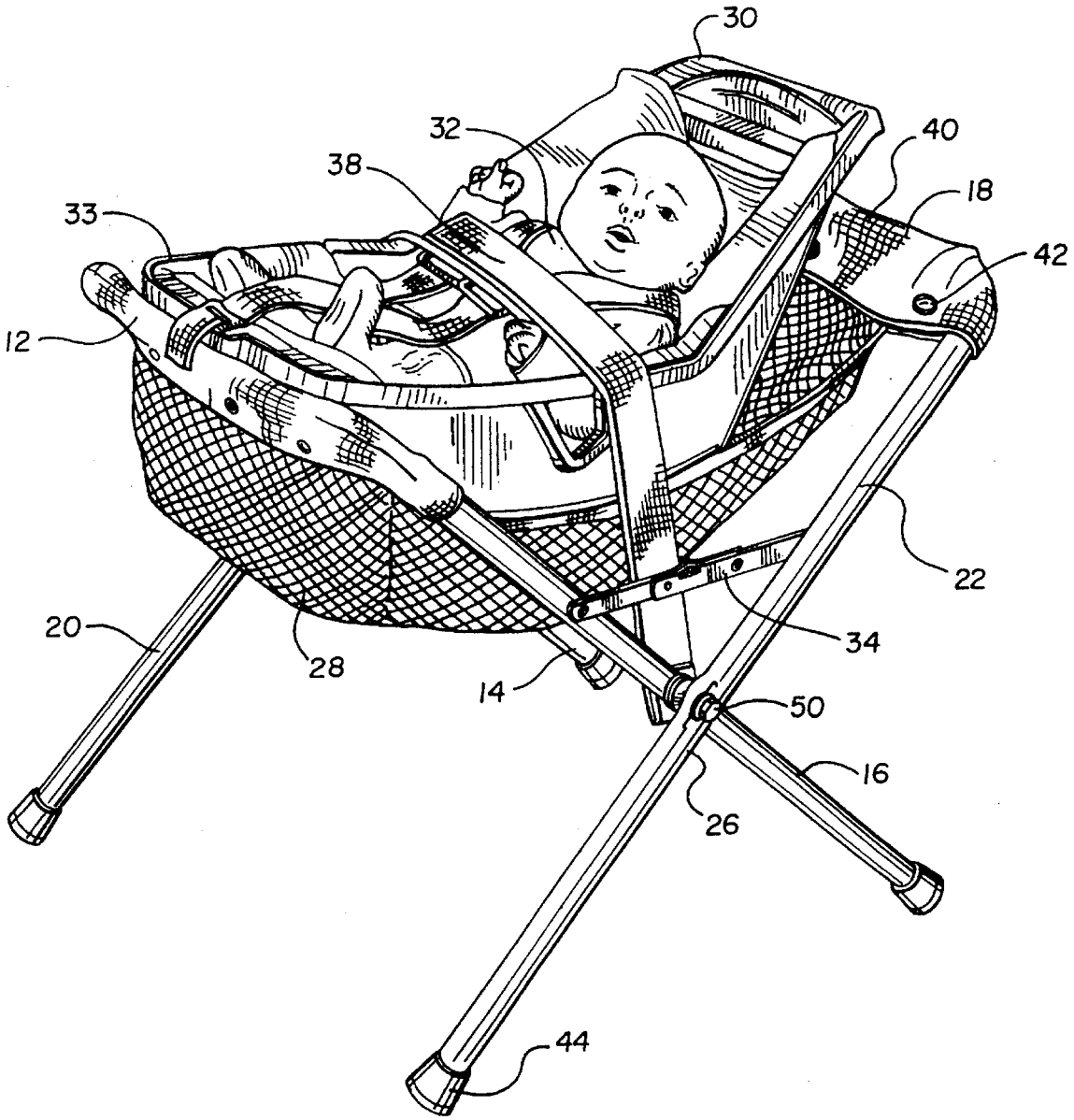
FIG. 2 is a perspective view of the foldable cradle of FIG. 1 including an infant seat with an infant secured therein.

Referring now to FIG. 1, a perspective view of a foldable cradle 10 for supporting an infant seat is illustrated. Referring also to FIG. 2, the foldable cradle 10 of FIG. 1 is depicted with an infant seat 30 and an infant 32 secured thereon.

The foldable cradle 10 includes a pair of spaced, generally parallel cross-members, a first cross-member 12 and a second cross-member 18. Each cross-member has a first leg depending from one end thereof and a second leg depending from the other end thereof. Thus, the first cross-member 12 has a first leg 16 depending from one end thereof and a second leg 14 depending from the other end thereof. The second cross-member 18 has a first leg 22 depending from one end thereof and a second leg 20 depending from the other end thereof.

The first legs 16, 22 are pivotally connected at a point 26 intermediate the first legs 16, 22. The second legs 14, 20 are also pivotally connected at a point 24 intermediate (See FIG. 3) the second legs 14, 20.

In a preferred embodiment, the foldable cradle 10 comprises a first U-shaped member having first cross-member 12 with first leg 16 depending from one end thereof and second leg 14 depending from the other end thereof. The foldable cradle further includes a second U-shaped member having a second cross member 18 with a first leg 22 depending from one end thereof and a second leg 20 depending from the other end thereof. The first leg 22 of the second U-shaped member is pivotally connected to the first leg 16 of the first U-shaped member at an intermediate point 26 on each leg. The second leg 20 of the second U-shaped member is pivotally connected to the second leg 14 of the first U-shaped member at an intermediate point 24.

The cross-members and legs form a frame which, when in an open position, has an X-shape when viewed from the side. The cross-members 12, 18 are fixed at vertical elevations from a planar surface defined by the lengths of the legs. Likewise, in a preferred embodiment, the U-shaped members form a frame wherein, when it is in an open position, the first cross-member 12 is generally parallel and spaced a horizontal distance from the second cross-member 18.

Figure 7:
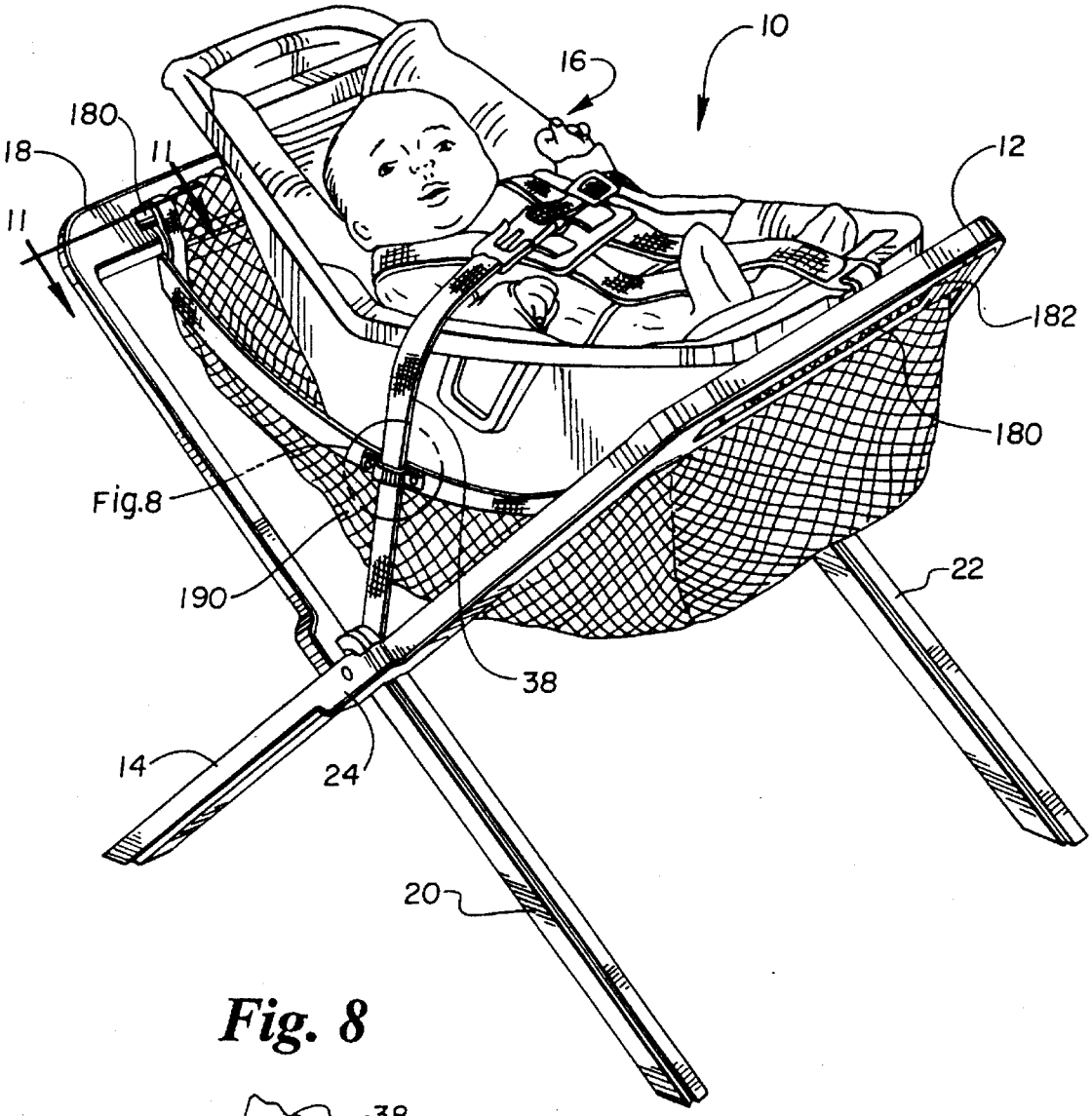
FIG. 7 is a perspective view of an alternative embodiment of a foldable cradle incorporating molded plastic U-shaped cross members and legs.

Next referring to FIG. 7, a preferred foldable cradle 10 incorporating a first U-shaped member, manufactured as a unitary piece from molded plastic and a second U-shaped member manufactured from molded plastic, cooperatively assembled to form the frame is depicted. Each U-shaped member, as with the embodiment depicted in FIG. 1, includes cross members 12, 18 with first legs 16, 22 depending from one end thereof, and second legs 14, 20 depending from the other end thereof. The first leg 22 of the second U-shaped member is pivotally connected to the first leg 16 of the first U-shaped member at an intermediate point on each leg. A second leg 20 of the second U-shaped member is pivotally connected to the second leg 14 of the first U-shaped member at an intermediate point 24. As with the previous embodiment, this assembly forms an X-shaped frame when in the open position.

Figure 10:
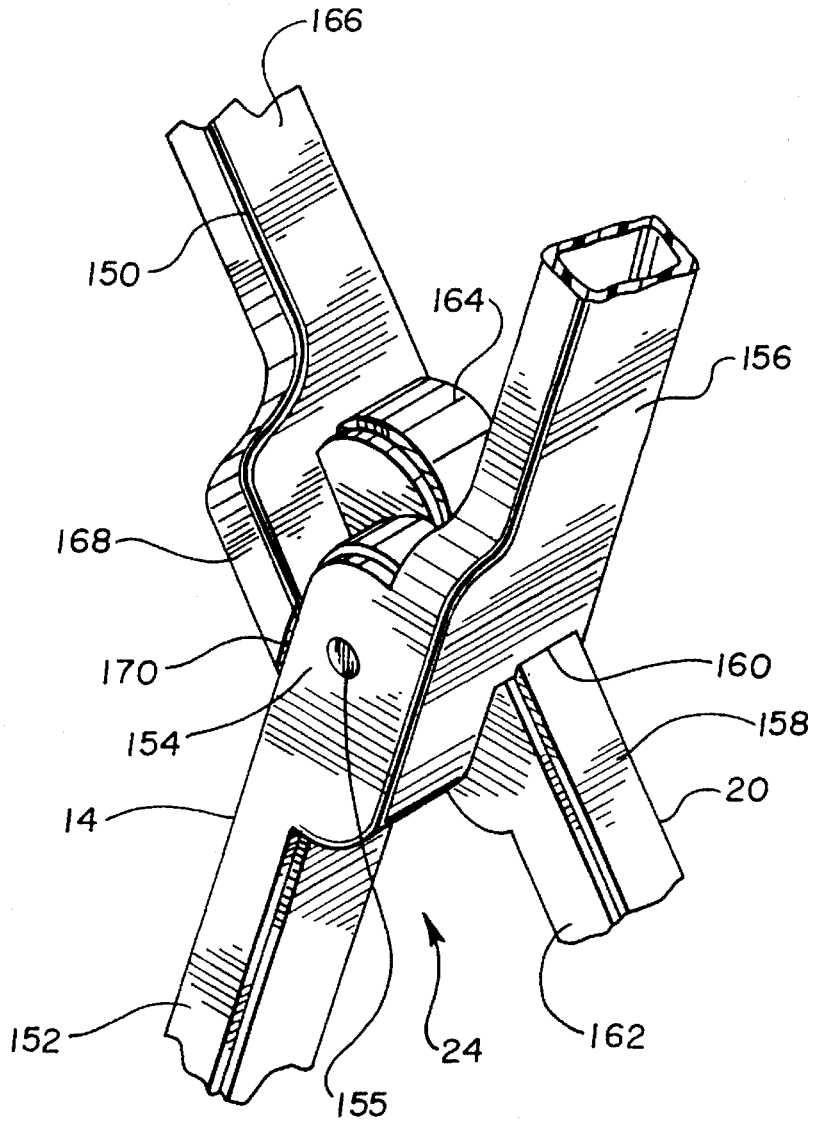
FIG. 10 is a detailed perspective view of the pivot area in the preferred embodiment of FIG. 7.

The U-shaped members depicted in the frame of FIG. 7 are each manufactured as unitary pieces from molded plastic. A detailed view of the pivot area for one pair of legs 14, 20 is depicted in FIG. 10. The molded legs are hollow, preferably with a generally rectangular cross section. To increase the strength of the legs, at least one edge or corner over substantially the length of the leg includes a rectangular indent or channel 150. The pivot area 24 in the preferred embodiment depicted in FIG. 10 includes a joint with preformed stops which limit the movement of the pivot to a predetermined, fully opened position.

The stops are molded into the legs 14, 16, 20, 22. The first leg 14 includes a lower portion 152 which terminates in the pivot area 24 with a knuckle 154. A pivot pin 155 extends through a hole in the knuckle 154. Extending upward from the knuckle 154 is the upper portion 156 of leg 14. The upper portion 156 is laterally displaced from the lower portion 152 at the knuckle. This allows the upper portion 156 of the leg 14 to overlap an upper side 158 of the second leg 20 proximate the pivot point. The laterally displaced upper portion 156 of the first leg 14 includes a flat surface 160 at its lower end which abuts against the upper surface 158 of the second leg 20 when the frame is in the fully opened position. Thus, the sling 28 does not act as the limit or stop for determining the fully open position of the frame. The leg assembly in the pivot area 24 fixes the fully opened position, and the flexible member 28 may hang freely without being distorted by the stress of holding the frame in proper location.

In a preferred embodiment, the pivot area 24 of the legs 14 and 20 include a second stop which further strengthens and holds the foldable cradle in proper position when fully opened. The second leg 20 includes a lower portion 162 which terminates in a knuckle 164, similar to that described for the first leg 14. The second leg 20 includes an upper portion 166 which is essentially collinear with the lower portion 158. However, in the area of the knuckle 164 a shoulder 168 protrudes laterally from the knuckle 164. The shoulder 168 includes a flat surface 170 which operatively contacts the upper surface of the lower portion 152 of the first leg 14 when the frame assembly is in a fully opened position. Thus, in a preferred embodiment, a dual stop assembly is incorporated which strengthens the pivot area 24 when in a fully opened position. The cradle assembly cannot be unfolded too far wherein the infant seat may be pushed upward or tipped over. This same dual stop assembly is provided on the other side of the foldable cradle where first and second legs 16, 22 meet in a pivot area.

The foldable cradle 10 includes means for supporting an infant seat, as illustrated in FIGS. 1, 2 and 7. The means for supporting the infant seat include a flexible member 28 secured at one end to one of the cross-members 12, 18 and secured at an opposite end to the other of the cross-members 12, 18. When so secured, the flexible member 28 forms a sling wherein the infant seat is supported by the flexible member 28 as suspended between the first cross-member 12 and the second cross-member 18.

The flexible member 28 is preferably a meshed fabric material. The meshed fabric material could include nylon strands which are connected in a web-like pattern, as depicted in FIG. 1.

The flexible member 28 can be of any suitable shape for supporting a typical infant seat 30. It is, however, preferable to shape the flexible member to generally conform to the underside of a typical infant seat 30. The preferred shape can have a generally flat bottom 27 and generally perpendicular sides 23, 25, 29, 31 extending vertically from the bottom 27. The flexible member 28 is affixed to the cross-member 12 along the terminal end of one side 29 and to cross-member 18 along the terminal end of the opposing side 31. The other two sides 23 25 of flexible member 28 are generally perpendicular to the cross-members 12, 18 and provide support along the sides of the infant seat 30. It will be understood that, although the flexible material 28 is generally shaped similar to the bottom of the infant seat 30, it readily conforms to any variations in shape which may be presented. This flexibility accommodates infant seats of varying design from different manufacturers.

The flexible member 28 may be attached to cross members 12, 18 by any conventional means. As depicted in FIG. 1, a preferred method of attachment includes a removable batting material 40 incorporating snaps 42 which releasably secure the flexible member in place. The flexible member may be readily removed for replacement or cleaning with this preferred design.

Figure 11:
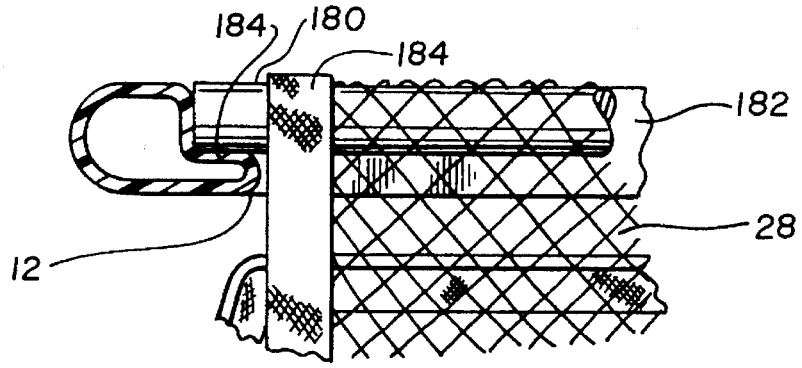
FIG. 11 is a detailed partial cross-sectional view of a preferred means for attaching a sling to the foldable cradle along the line 11—11 of FIG. 7.

An alternative means for attaching flexible member 28 is depicted in FIG. 7. This means works well when the frame members are molded from a polymer or plastic. This method of suspending the flexible member 28 includes a rod 180 and channel 182 assembly or combination. The flexible member 28 includes a looped end through which the rod 180 may be inserted. The channel 182, as depicted in detail in FIG. 11 as a partial cross section, extends through the frame member 12 over a portion of its length. Near the end of the channel 182, a stop 184 is located at each end. This slot 184 engages a portion of the rod 180 to prevent the rod from slipping through the channel when assembled. Thus, the end of the flexible member 28 having the loop 184 thereon is extended through the channel 182. When through the channel 182, the rod 180 is inserted therethrough. When the rod 180 is allowed to slide back into the channel 182, the stops 184 engage the end of the rod 180 to hold the flexible member 28 suspended in place. Thus, the flexible member 28 may be readily removed for cleaning or replacement.

The foldable cradle 10 can have a first cross-member 12 which is elevated higher than the second cross member 18 when the frame is in an open position. With this design, a foot end 33 of an infant seat 30 can be disposed beneath, and extend horizontally beyond, the first cross-member 12. The flexible member 28 supports the foot end 33 and cooperates with the first cross-member 12 to secure the infant seat 30 in place. To accomplish this the legs of one of the cross-members are longer than the other legs of the other cross-member so that, in the open configuration as illustrated in FIG. 1, the elevation from the floor of one cross-member is greater than the other cross-member.

The legs and cross-members can be constructed from rigid tubular material. A preferred material is one-inch hollow, tubular steel of sufficient gauge to support an infant and seat.

Figure 3:
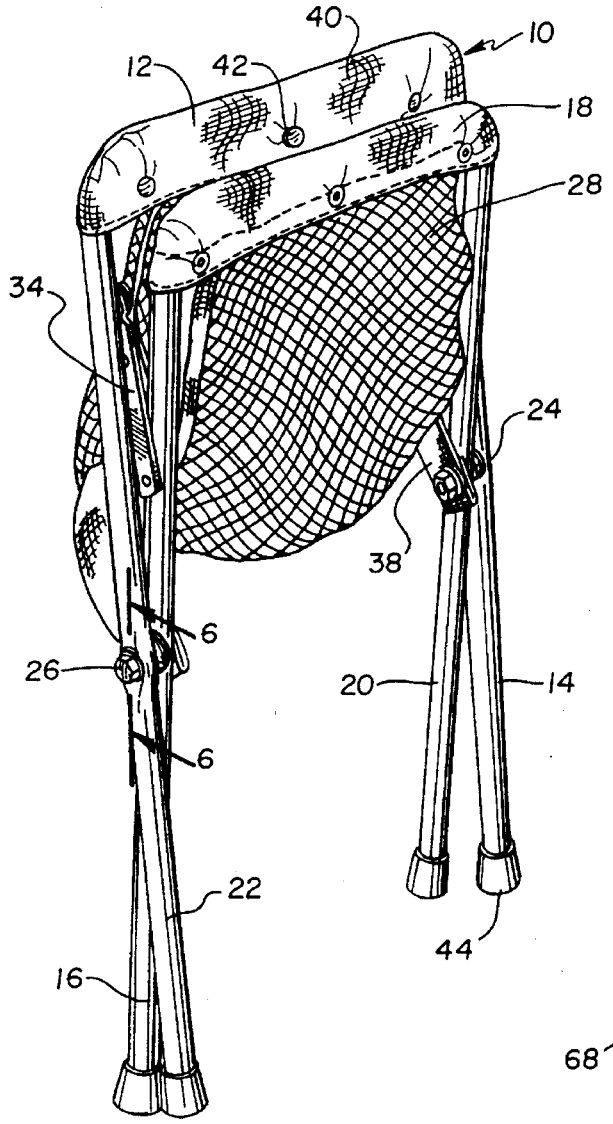
FIG. 3 is a perspective view of a foldable cradle in a folded position.

Referring now also to FIG. 3, the foldable cradle 10 is shown in a folded position. In changing the foldable cradle 10 from the open position as pictured in FIG. 1 to the closed position in FIG. 3, the pivotally connected legs rotate relative to each other at intermediate points 24, 26 on the legs.

Figure 6:
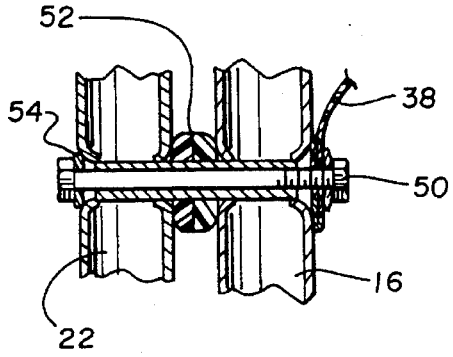
FIG. 6 is a detailed cross-sectional view of the pivot point on the foldable cradle of FIG. 3 along the line 6—6.

Referring now also to FIG. 6, a detailed cross-section of the point of pivot on the foldable cradle 10 of FIG. 3 along the line 6—6 is illustrated. The preferred pivot point is constructed to be easily operated. In a preferred embodiment, the pivot point 26 includes a bolt 50 which passes through both legs 16, 22. The bolt is enclosed within a bushing 54. The bushing is preferably nylon.

The pivot assembly also includes a second bushing 52 which is disposed between the legs 16, 22, having both the bolt 50 and bushing 54 passing therethrough. Although this construction is preferred, any conventional means for connecting the legs at intermediate points 24, 26 in a manner which allows pivoting of the legs, one relative to the other in order for the frame to be folded, may be utilized.

The foldable cradle 10 can have at least one locking brace 34. It is preferable that two locking braces 34, 36 be incorporated into the foldable cradle 10. When the frame is in an open position, the locking brace 34, being affixed at a point on each of the two pivotally connected legs at a distance from the point intermediate the legs, prevents folding of the cradle during use. Thus, in the preferred embodiment, the brace, when locked, prevents the first U-shaped member and the second U-shaped member from pivoting relative to one another.

The locking brace 34 preferably comprises a first rigid member pivotally connected, proximate one end, to an end of a second rigid member. The brace includes means for fixedly aligning the first rigid member relative to the second rigid member when the frame is in the open position. Conventional braces of this design are well known.

A safety strap 38 can be included with the foldable cradle 10 of the present invention. The safety strap 28 is adjustably secured, at each end thereof, to one of the pivot points 24, 26 on the pivotally connected legs. As best illustrated on FIG. 2, the safety strap 38 extends over the top of the flexible member 28 and the infant seat 30 so that the infant seat is further secured in a fixed position. The safety strap 38, as depicted in FIG. 1, is of a two-piece construction with Velcro strips included thereon for securement. Other conventional means for securing the lengths of the safety strap 38, such as a buckle, may be utilized.

Figure 8:
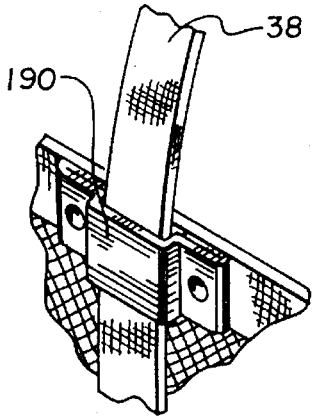
FIG. 8 is a detailed perspective view of a strap support utilized in a preferred embodiment.

As depicted in FIG. 7, the safety strap may also pass through a retaining bracket 190 which prevents the strap from falling to the floor when in an unlatched position. A detail of the retaining bracket 190 is depicted in FIG. 8. The retaining bracket 190 is attached to the side wall or surface of the flexible member 28 and slidably receives the safety strap 38 therethrough. Any known means for attaching the retaining bracket 190 may be utilized.

Figure 4:
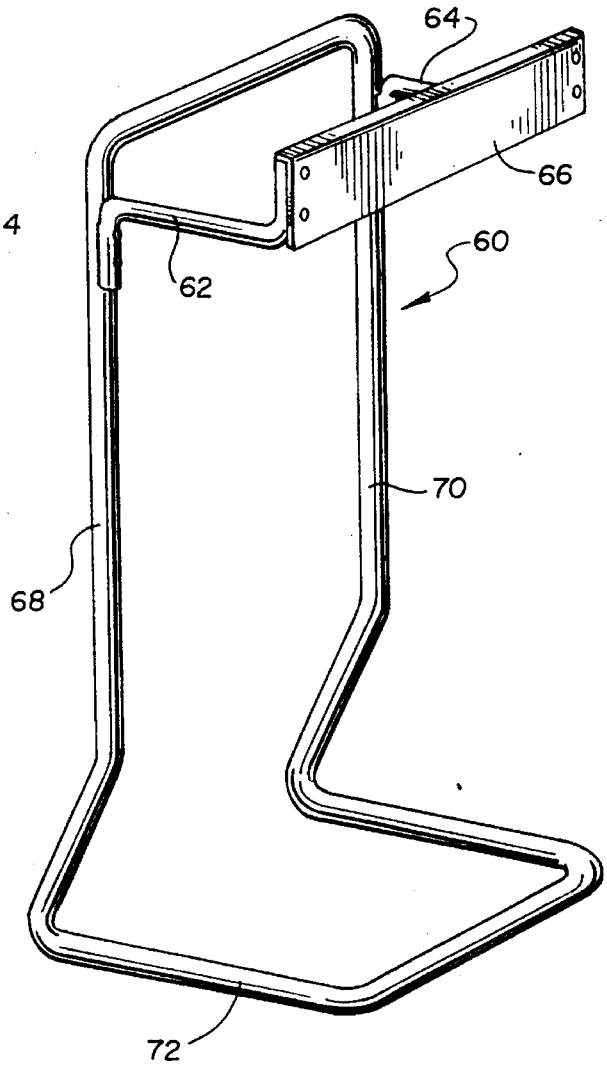
FIG. 4 is a perspective view of a stand for supporting a plurality of folded infant seat cradles.
Figure 5:
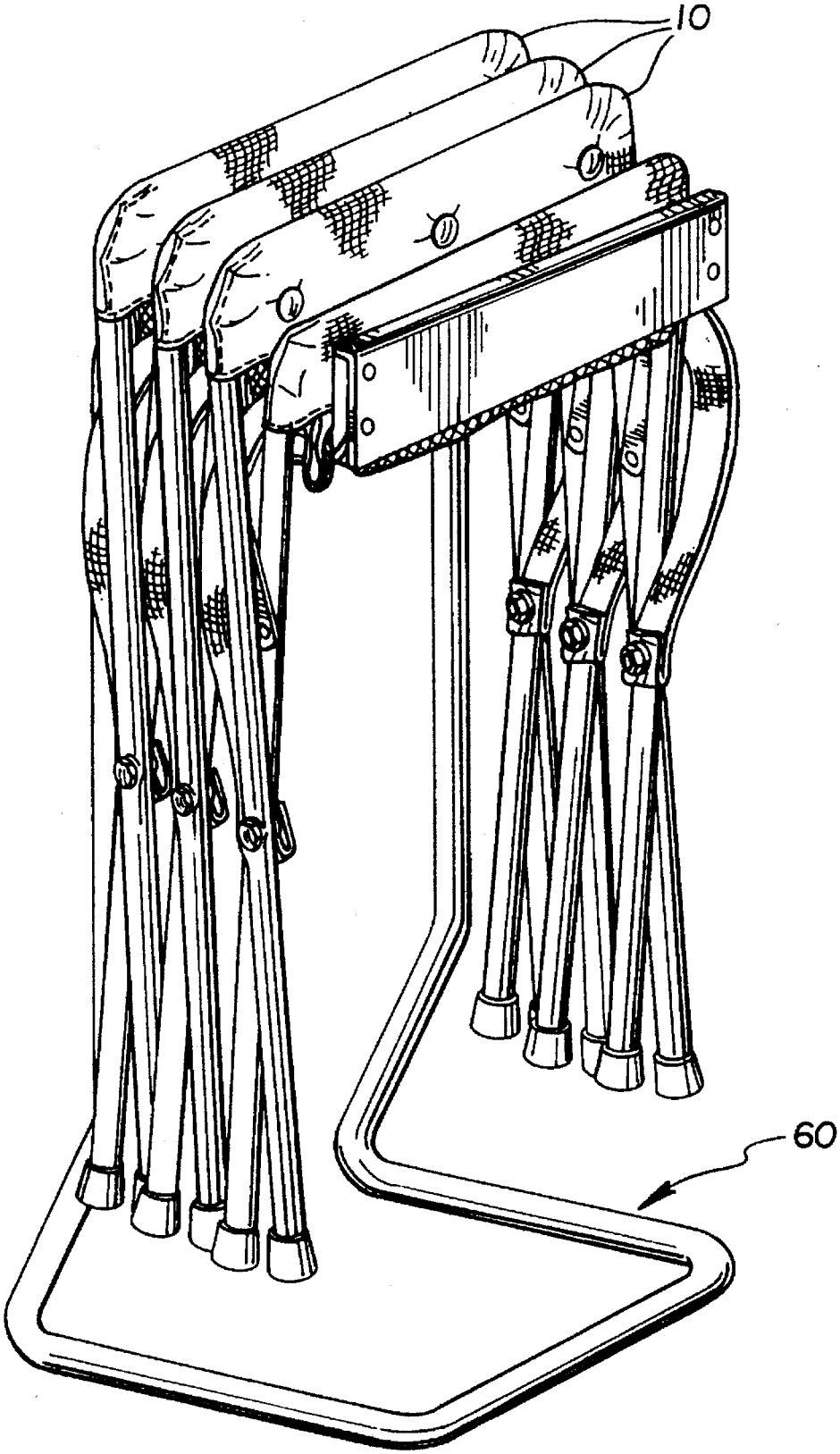
FIG. 5 is a perspective view of the stand of FIG. 4 including three folded cradles supported thereon.

Next referring to FIG. 4 and FIG. 5, a plurality of foldable cradles 10 in combination with a support stand 60 are illustrated. The support stand 60 includes at least one generally horizontal support arm 62 extending from a vertical support at an elevated position. The vertical support as depicted in FIG. 4 includes a rigid tubular frame having two vertical legs 68, 70. The preferred support stand 60 includes two generally horizontal support arms 62, 64 and a stop plate 66. As shown in FIG. 5, a plurality of foldable cradles are engaged along the cross-members of the foldable cradles 10 by the upper surface of the horizontal support arms 62, 64 for secure storage in a folded position.

Figure 9:
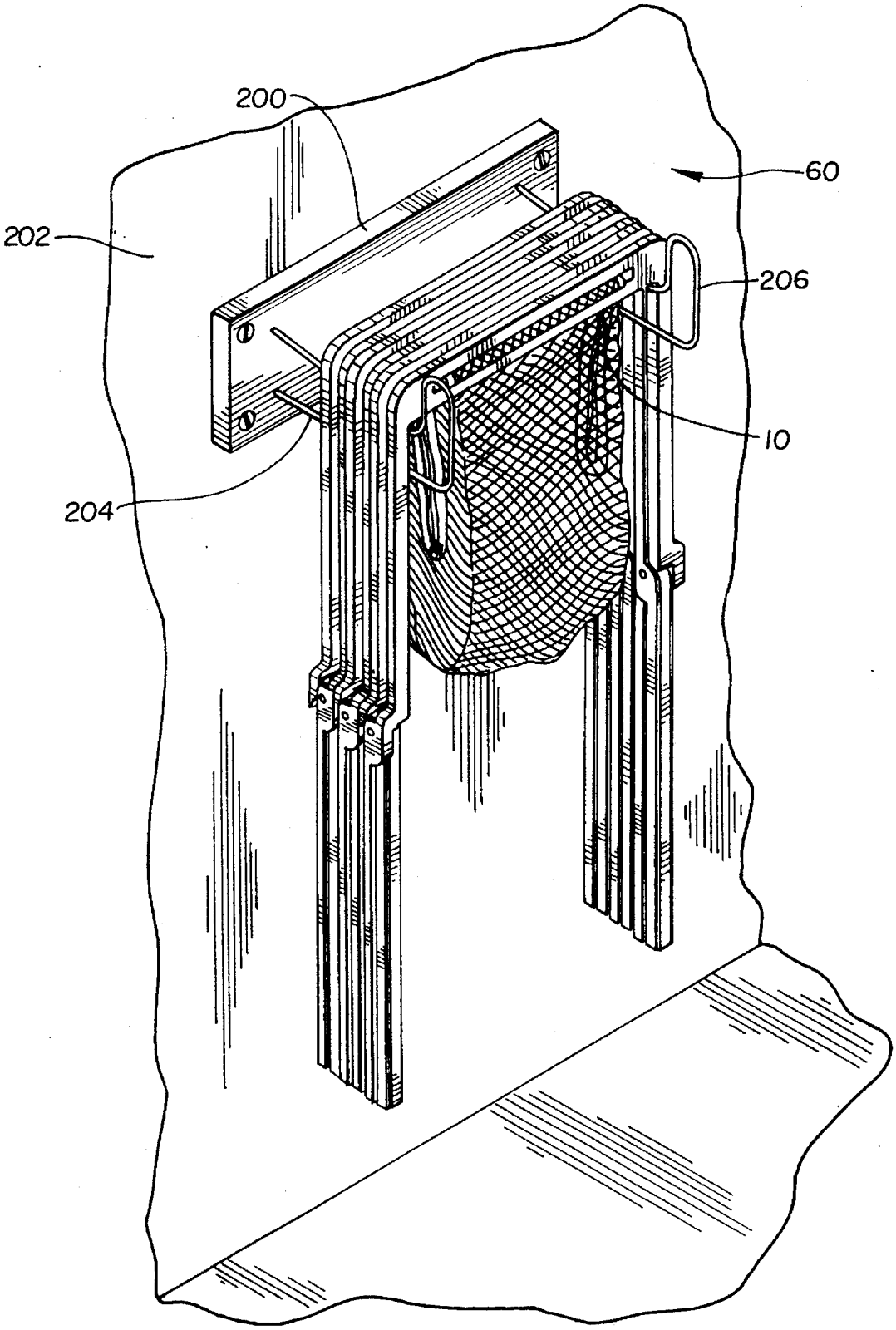
FIG. 9 is a perspective view of an alternative wall mounted support stand.

An alternative support stand 60 is depicted in FIG. 9. This support stand is wall-mounted and includes a backing plate 200 which is affixed to a wall 202. Extending horizontally from or projecting from the backing plate 200 is at least one horizontal bracket 204. In a preferred embodiment, a second horizontal bracket 206 projects from backing plate 200. As with the previously disclosed support stand 60, a plurality of foldable cradles 10 may be received along the cross-members of the foldable cradles 10 by the upper surface of the horizontal support arms 204, 206 for secure storage of the cradle in a folded position.

The support stand 60 allows easy storage of the foldable cradle. Thus the foldable cradles 10 do not occupy excessive floor space when not in use and may be quickly set up at a table or other location when needed.

Legs of a cradle 10 may include pads 44 which prevent marring of floor surfaces. Such structure is seen in a number of figures and identified in FIGS. 1, 2, and 3.

Figure 12:
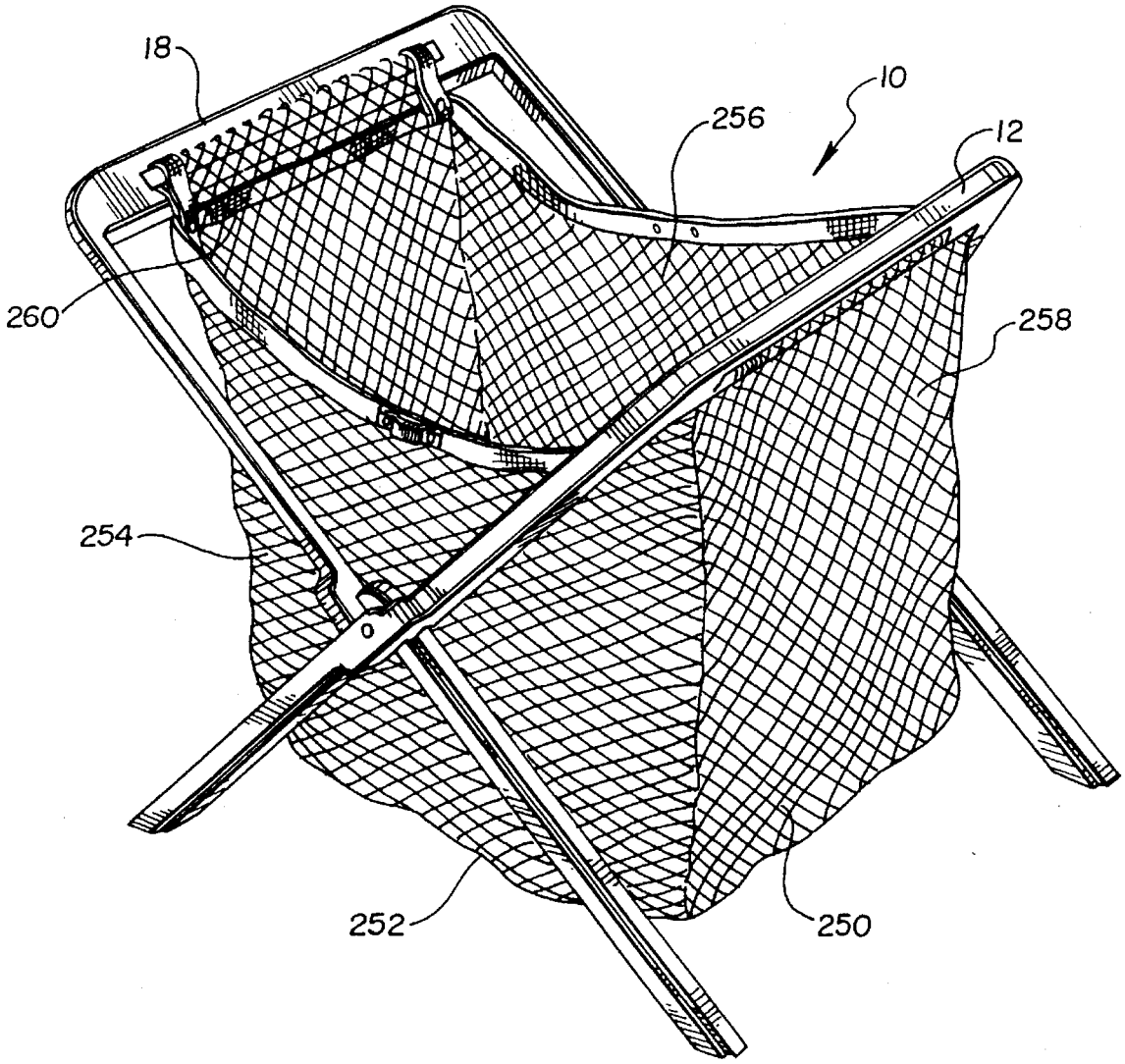
FIG. 12 is a perspective view of the foldable cradle converted to a storage bin.

In a preferred embodiment, the cradle of the present invention is sold in a kit which includes at least two flexible members. The first flexible member 28 has been previously described for use with an infant seat. Referring to FIG. 12, a second flexible member 250 is illustrated mounted on the cradle. The second flexible member 250 gives the foldable cradle of the present invention a second utility which becomes important when the infant has outgrown the infant seat and no longer needs the support cradle/infant seat combination. The second flexible member 250 is suspended in exactly the same way as the first flexible member 28 depicted in FIG. 7. As shown in FIG. 12, the same extruded plastic frame members are depicted. As suspended, the second flexible member 250 has a depth which nearly reaches the floor. The flexible member 250 is generally box-shaped including a flat bottom 252 and vertical sides 254, 256, 258 and 260. Although this general configuration is preferred, other shapes are recognized as possible. The foldable cradle 10 with the second flexible member 258 may be utilized for storing toys, laundry or other articles.

New characteristics and advantages of the invention covered by this document have been set forth in the foregoing description. It will be understood, however, that this disclosure is, in many respects, only illustrative. Changes may be made in details, particularly in matters of shape, size, and arrangement of parts, without exceeding the scope of the invention. The scope of the invention is, of course, defined by the language in which the appended claims are expressed.

What is claimed is:

1. A foldable cradle for supporting an infant seat comprising:

(a) a first U-shaped member having a first cross-member with a first leg depending from one end thereof and a second leg depending from an opposite end thereof;

(b) a second U-shaped member having a second cross-member with a first leg depending from one end thereof and a second leg depending from an opposite end thereof;

(c) said first leg of said second U-shaped member pivotally connected to said first leg of said first U-shaped member at an intermediate point on each leg, and said second leg of said second U-shaped member pivotally connected to said second leg of said first U-shaped member at an intermediate point on each leg, said U-shaped members forming a frame wherein, when the frame is in an open position, said first cross-member is generally parallel and spaced a horizontal distance from said second cross-member;

(d) means for supporting an infant seat, said means including a flexible member attached at one end to said first cross-member and attached at an opposite end to said second cross-member, said flexible member including a pair of generally vertical side panels defining a width thereof, wherein said infant seat is securely supported by said flexible member in combination with said side walls; and (e) a safety strap, said strap secured at the respective ends thereof to each of said intermediate points on said pivotally connected legs, said strap, in use, extending over the top of said flexible member so that said infant seat is secured in a fixed position.

2. The foldable cradle of claim 1, further comprising a pair of retaining brackets fixedly attached to said side walls for slidably receiving said safety strap therethrough.

3. In combination, a support stand having at least one generally horizontal support arm extending from a vertical support at a position elevated above a surface and a plurality of folded cradles for supporting infant seats suspended from said horizontal support arm, wherein each of said folded cradles includes, (a) a pair of generally parallel cross-members, each cross-member having a first leg depending from one end thereof and a second leg depending from the other end thereof, said first legs pivotally connected at a point intermediate said first legs and said second legs pivotally connected at a point intermediate said second legs, and (b) means for supporting an infant seat, said means including a flexible member attached on one end to one of said cross-members and attached on an opposing end to the other of said cross-members, wherein when one of said folded cradles is removed from said support stand and pivoted to an open position, said infant seat is supported by a sling as formed by said flexible member as suspended therebetween, said sling including a pair of generally vertical side panels defining a width thereof, said side panels supporting such infant seat in use.

4. The combination of claim 3, wherein said flexible member is a webbed meshed fabric material.

5. The combination of claim 3, wherein said support stand includes two horizontal support arms having said cross-members of each cradle supported on a surface thereof.

6. A kit including a convertible foldable cradle for supporting an infant seat or for use as a storage bin, comprising:

(a) a pair of spaced, generally parallel cross-members, each cross-member having a first leg depending from one end thereof and a second leg depending from the other end thereof, said first legs pivotally connected at points along said first legs, and said second legs pivotally connected at points along said second legs so that, in an open position, a frame having a generally X-shape, when viewed from the side, is formed, said cross-members each at a fixed vertical elevation from a plane defined by the opposite ends of said legs;

(b) means for supporting an infant seat, said means including a first flexible member releasably attached, at one end thereof, to one of said cross-members, and releasably attached, at an opposite end, to the other of said cross members, to form a sling, said sling including a pair of generally vertical side panels defining a width thereof, wherein said infant seat is securely supported by said first flexible member; and (c) means for converting said foldable cradle for supporting an infant seat to a storage bin, said means including a second flexible member, interchangeable with said first flexible member, releasably securable in the same way as said first flexible member, having a generally flat bottom vertically displaced downward from said cross-members and side walls connected thereto to form a volume for storage as suspended between said cross-members.

7. The kit of claim 6, wherein each of said cross-members and associated legs comprise a unitary molded plastic U-shaped member.

8. The kit of claim 7, wherein said first legs each include an upper portion and a lower portion separated by an integral knuckle molded therein, said first legs pivotally connected at said knuckle.

9. The kit of claim 8, wherein at least one of said knuckles of one of said first legs includes a shoulder having a surface which abuts a surface of said other of said first legs when said foldable cradle is in a fully open position, said shoulder providing a stop which predetermines said fully open position and prevents stress on said sling.

* * * * *